United States Patent [19]

Miller

[11] Patent Number: 4,883,206

[45] Date of Patent: Nov. 28, 1989

[54] TENT/COT/BACKPACK STRUCTURE

[76] Inventor: Irvin W. Miller, 8 Forrestal Dr. NASB, Brunswick, Me. 04011

[21] Appl. No.: 259,306

[22] Filed: Oct. 18, 1988

[51] Int. Cl.[4] ..... A45F 4/02; A45F 4/04; A45F 4/06

[52] U.S. Cl. ..... 224/153; 224/154; 224/156; 224/210; 224/261; 5/114; 135/96

[58] Field of Search ..... 224/257, 259, 261, 263, 224/151, 153, 154, 156, 202, 209, 210; 5/110, 111, 114, 413, 508; 135/95, 96

[56] References Cited

U.S. PATENT DOCUMENTS

| | | | |
|---|---|---|---|
| 3,757,360 | 9/1973 | Wescott | 224/154 X |
| 3,828,992 | 8/1974 | Cerchione | 224/156 |
| 3,912,138 | 10/1975 | Pava | 224/156 X |
| 3,933,164 | 1/1976 | Ness et al. | 224/156 |
| 3,971,495 | 7/1976 | Velazquez | 224/156 |
| 4,056,857 | 11/1977 | Quantz | 5/112 |
| 4,234,005 | 11/1980 | Taylor, III | 224/154 X |
| 4,286,739 | 9/1981 | Silcott et al. | 224/156 |
| 4,511,071 | 4/1985 | Curran | 224/156 |
| 4,538,750 | 9/1985 | Hanna | 224/156 |

FOREIGN PATENT DOCUMENTS

| | | | |
|---|---|---|---|
| 0056361 | 7/1982 | European Pat. Off. | 224/153 |
| 2331301 | 6/1977 | France | 224/154 |
| 2115275 | 9/1983 | United Kingdom | 224/151 |

*Primary Examiner*—Ernest G. Cusick
*Attorney, Agent, or Firm*—William Nitkin

[57] ABSTRACT

A backpack/cot/tent structure usable in a first mode as a backpack and convertible to a cot when the framework is separated into upper and lower sections with an integral tent member that can be set up to surround the cot.

3 Claims, 3 Drawing Sheets

TENT/COT/BACKPACK STRUCTURE

BACKGROUND OF THE INVENTION

1. Field of the Invention

The device of this invention resides in the field of combination backpack/tent/cot structures and more particularly relates to a backpack which has a framework that can be converted to a cot and has a tent integrally associated therewith to cover the structure when it is in its cot mode.

2. Description of the Prior Art

Currently if one wishes to enjoy the comfort of sleeping on a cot when hiking with a backpack and camping overnight, one must carry a backpack, a cot, and a tent. However, carrying such separate items along with the backpack is both awkward and burdensome to the backpacker.

SUMMARY OF THE INVENTION

It is an object of this invention to combine the backpack, cot and tent structures into one unit by providing a convertible framework for the backpack which framework can be used as a backpack and then converted when desired into a cot and which structure further contains therewith a tent to be set up in association with the cot structure.

It is a further object of this invention to provide a lightweight backpack with storage space therein which backpack framework can be easily converted into a cot for use while camping and which has a tent integrally associated therewith which when set up surrounds the cot.

DESCRIPTION OF THE PREFERRED EMBODIMENT(S)

The structure of this invention is a combination backpack/cot/tent having three modes: the first mode being when the framework of the structure is fitted together and the structure is used as a backpack; the second mode being when the backpack is removed from the individual carrying it and the framework members are separated to form a cot member; and the third mode being when the integral tent structures is used to cover the cot member. The framework members form the cot support structure and also have associated therewith a tent member with a tent pole structure which extends from a portion of the framework to support a tent around the cot member. Thus the structure of this invention is a self-contained backpack/cot/tent which is highly desirable and useful for hikers/campers who do not wish to carry all these separate items with them when both hiking and camping. By using the convenient structure of this invention, a hiker/camper can reduce the weight of his backpack as well as realize monetary savings in not having to buy a separate backpack, cot and tent as is necessary in the prior art.

Figure 1:
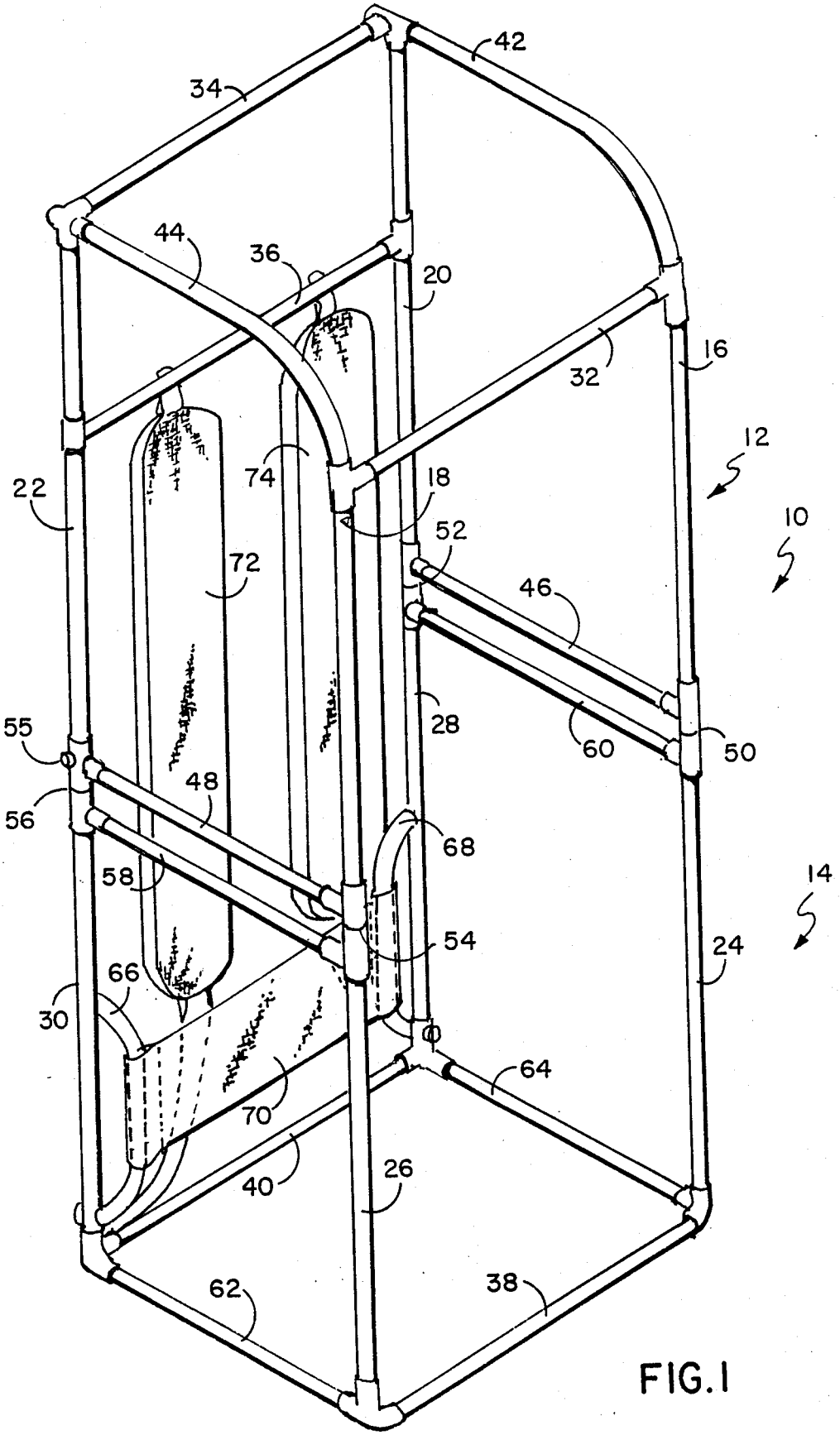
FIG. 1 is a perspective view of the framework of the backpack of this invention in an upright position as it might be attached in its first mode to a hiker's back.

FIG. 1 illustrates the framework of backpack assembly 10 with the storage bags, cot and tent which will be described below, removed therefrom and which framework is shown in its upright interconnected first mode to be placed on a user's back. In its first mode as a backpack, upper framework 12 is attached to lower framework 14. Seen in this view are the tubular members of upper framework 12 and lower framework 14 which form a rectangular box-like empty frame for support of the storage bag members and cot which items will be described below. Upper right front frame member 16 and upper left front frame member 18 are engaged respectively to lower right front frame member 24 and lower left front frame member 26 at first mating joint 50 and second mating joint 54. These frame members can be hollow tubular members which can be made of aluminum or other equivalent lightweight material. At first mating joint 50 and second mating joint 54 a portion of one frame removably inserts into the hollow of the other frame. Such junctions are commonly used for frameworks of tents and camping equipment and are well-known. In parallel relationship to the front frame members are the rear frame members, being upper right rear frame member 20 and upper left rear frame member 22. On the lower framework are lower right rear frame member 28 and lower left rear frame member 30, also spaced apart and in parallel relationship to lower front frame members 24 and 26. The left and right upper rear frame members are releasably joined respectively to the left and right lower rear frame members in similar fashion at third mating joint 52 and fourth mating joint 56 by having a narrowed portion of one insert into the mating hollow of the other. There are a series of front and rear cross braces holding the frame members together being upper rear cross brace 34 and upper front cross brace 32 as well as lower rear cross brace 40 and lower front cross brace 38 which are attached to the front and rear frames and extend between the right and left frame members so as to form a portion of the generally rectangular structure separating the right and left portions of the frame members a distance apart which constitute the width of the backpack as well as the width of the cot. On the upper side of the first, second, third and fourth mating joints 50, 52, 54 and 56 are upper right central support member 46 and upper left central support member 48, each of which respectively extends between upper right front frame member 16 and upper right rear frame member 20, and upper left front frame member 18 and upper left rear frame member 22 to connect the lower portions of the upper frame members. In a similar fashion lower right central support member 60 interconnects lower right front frame member 24 to lower right rear frame member 28, and lower left central support member 58 interconnects lower left front frame member 26 and lower left rear frame member 30. Upper right front frame member 16 and upper left front frame member 18 can be curved generally toward and interconnect respectively with the upper portions of upper right rear frame member 20 and upper left rear frame member 22 to form respectively upper right support member 42 and the upper support member 44. In the same fashion at lower framework 14, lower right support member 64 can interconnect lower right front frame member 24 to lower right rear frame member 28. To complete the rectangular structure lower left support member 62 interconnects lower left front frame member 26 to lower left rear frame member 30. In this way a generally rectangular structure is formed of which upper framework 12 is separable from lower framework 14 so as to form two portions when the device is utilized in its second mode as a cot to be held within a tent. The frame member at mating joints 50, 52, 54 and 56 can be held together by providing apertures in the frame members through which lockpins, such as lockpin 55, can be inserted to securely maintain the attachment of upper framework 12 to lower framework 14 until such lockpins are removed. In this way the structure of this invention can be used a a backpack with the area within the members of upper framework 12 containing a first storage bag and the area within lower framework 14 containing a second storage bag which storage bags will be described further below. Below upper rear cross brace 34 and between upper left rear frame member 22 and upper right rear frame member 20 extends strap support cross piece 36 from which extends a pair of straps with pads thereon being left shoulder strap 72 and right shoulder strap 74. These straps extend downward and are attached respectively to the base of left bracket 66 and right bracket 68 described below and are adapted as common straps to be passed over the shoulder of the carrier. In this structure back support web member 70 can be positioned thereon to help support the structure in its first mode at the midback of the carrier. Back support web member 70 is attached to right bracket 68 and left bracket 66 each of which is formed in a generally U shape and each respectively attached extending inward to lower right rear frame member 28 and the lower left rear frame member 30 by well known means of attachment such as by welding or equivalent attachment means.

Figure 2:
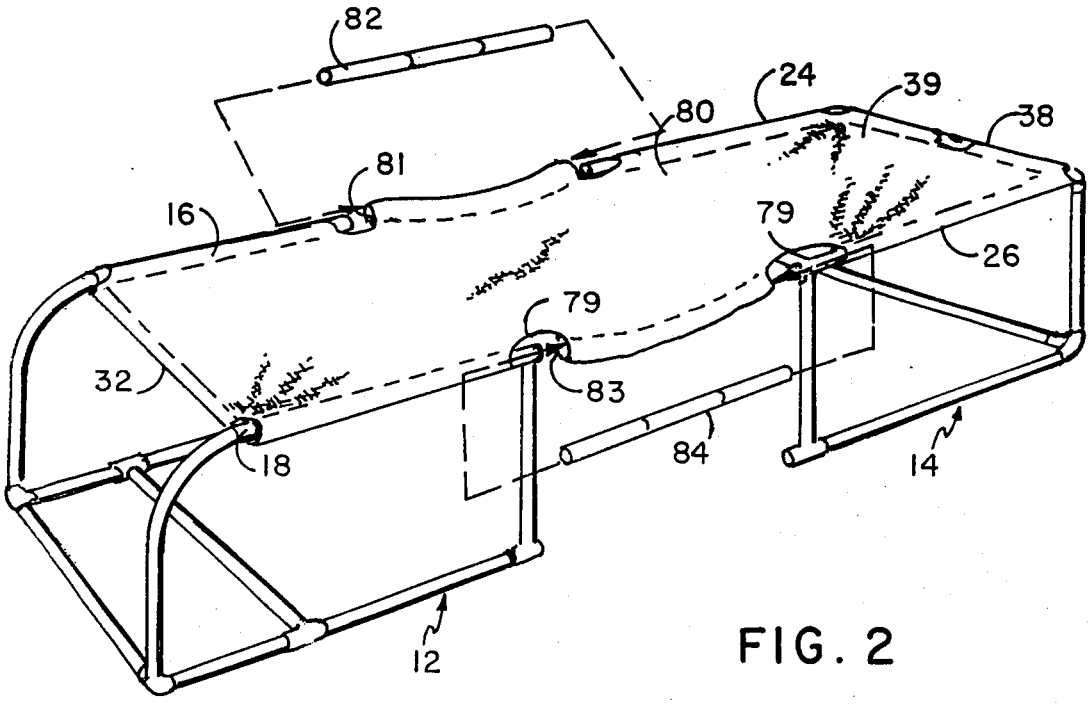
FIG. 2 illustrates the backpack framework in its second mode laid upon the ground with the upper framework separated from the lower framework and the cot member itself stretched therebetween with extension poles indicated.
Figure 3:
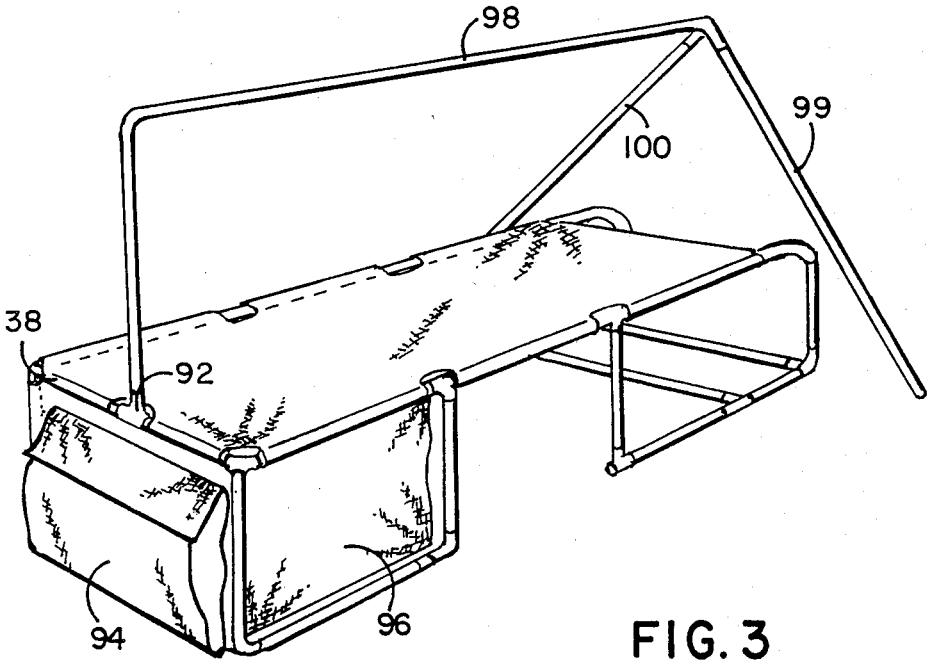
FIG. 3 illustrates the cot structure of this invention set up with the tent poles extending therefrom.

FIG. 2 illustrates the framework of this invention as depicted in FIG. 1 in its second mode as a cot where upper framework 12 has been separated from lower framework 14 after removal of the lockpins from the frame joints. Also seen in this view is cot fabric 80 which extends and is sewn around upper right front frame member 16, upper front cross brace 32, and upper left front frame member 18. By stitching cot fabric 80 thus around these members as is done in other cot structures which are created around tubular members, cot fabric 80 can also extend in the same fashion sewn around or attached by Velcro-type attachment means around lower left front frame member 26 and lower right front frame member 24. The attachment of cot fabric 80 around lower front cross brace 38 can allow for its disattachment at its bottom and reattachment at various lengths with Velcro strip 39 to allow for tension adjustment of cot fabric 80 on the frame member. Between upper framework 12 and lower framework 14 at mating joints 50 and 54, which provide on one side a narrower projecting member not seen and a mating hollow member on the corresponding mating pieces, can be inserted respectively two extension poles such as first extension pole 82 and second extension pole 84 which can be made of three interconnected pieces of pole, each with protrusions mating into adjacent hollow tubes which type of joint and pole breakdown is well known in tubular construction of ten frames and the like. These poles can be attached between the mating joints to extend lower framework 14 to upper framework 12 respectively through channels 81 and 83 formed in portions of cot fabric 80 sewed and cut so as to leave a space such as notch 79 between the cot portion and the junction portion so that the extension poles can be passed through channels 81 and 83 and then be removably affixed into the mating portions of the mating joints which are now separated apart from one another on upper framework 12 and lower framework 14. In this way the cot will have a structural framework forming a rectangular structure to provide a secure and comfortable cot elevated well above the ground on which the use can sleep. Cot fabric 80 is held off the ground by the series of support members extending between the front and rear frame members. At the portion of the lower front cross brace 38 can be formed, as seen in FIG. 3, tent pole aperture 92 into which tent pole 98 can be extended therefrom and curved above the center of the cot to a junction with its angularly displaced first side pole 99 and second side pole 100. These side poles can extend down to the ground and provide a framework for the tent, which can be held within storage bag 94 as seen in FIG. 3 disposed on the bottom of the lower framework. The tent can be removed from storage bag 94 and be of the typical triangular pup-tent style or other shape and can be extended over tent pole 98.

Figure 4:
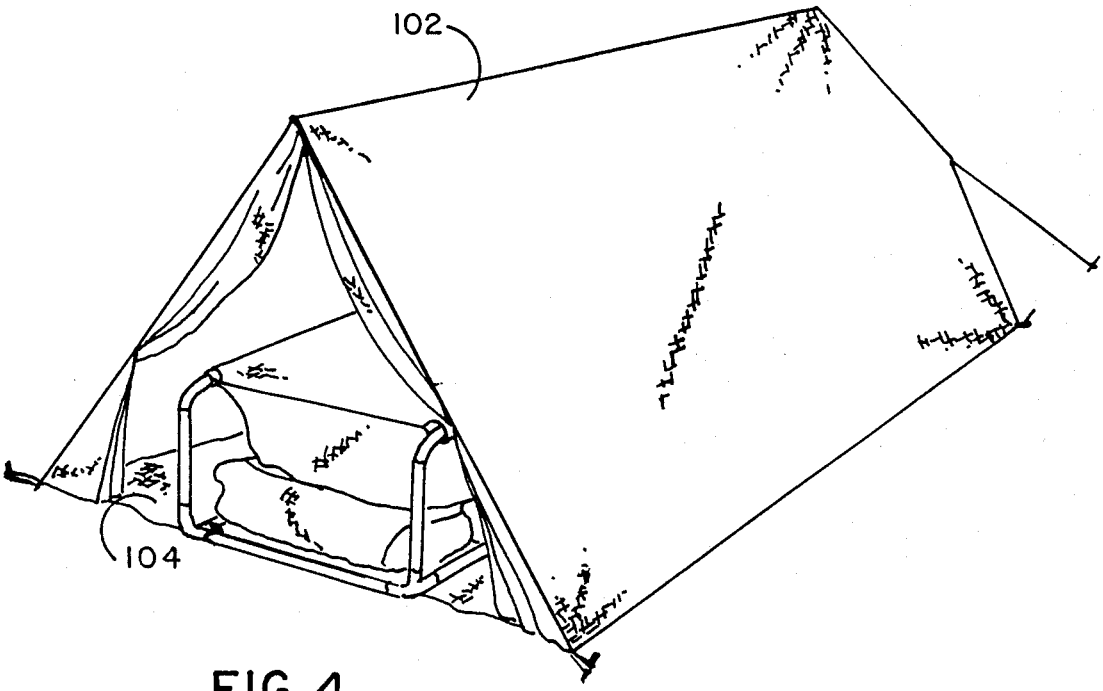
FIG. 4 illustrates a perspective view of the structure of this invention in its third mode with the tent erected over the cot member.

FIG. 4 illustrates a perspective view of the structure of this invention in its third mode with tent 102 erected over the cot member. Tent 102 having bottom 104, can be made of nylon or other equivalent material and can have the typical front flaps seen open but which when desired can close.

Figure 5:
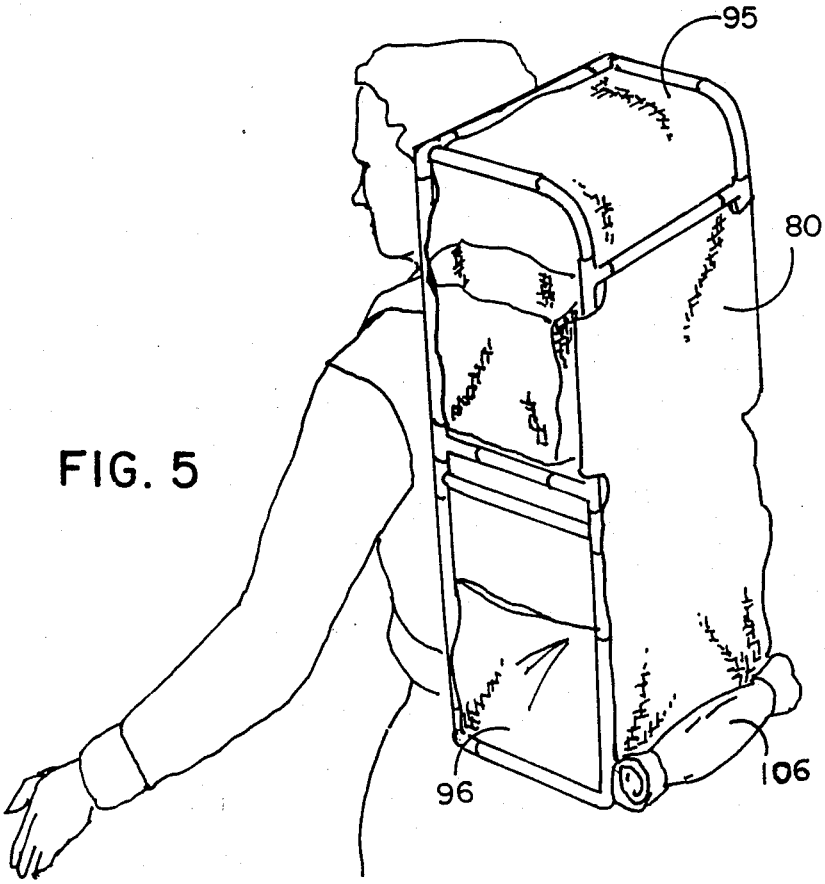
FIG. 5 illustrates the backpack of this invention in its backpack first mode with the upper and lower frameworks joined together, such structure shown carried on the back of a hiker.

FIG. 5 illustrates the backpack assembly in its first mode wherein the upper and lower frameworks have been joined together with cot fabric 80 in place as seen on the framework with loose middle 106 of cot fabric 80 rolled up with top storage bag 95 and bottom storage bag 96 in position within the frameworks. These storage bags can be used to hold the cot extension poles, the tent poles which can be of a plastic material and other paraphernalia that one would carry for backpacking and camping. Tent pack 94 is a small space-efficient bag which holds the tent and is attached to the bottom of lower framework 14.

Although the present invention has been described with reference to particular embodiments, it will be apparent to those skilled in the art that variations and modifications can be substituted therefor without departing from the principles and spirit of the invention.

We claim:

1. A backpack structure disposed in a generally vertical first mode when used as a backpack, comprising: an upper framework having an outer side and an inner side and a lower framework having an outer side and an inner side, said lower framework being releasably attached to said upper framework; storage areas defined respectively within said upper and lower framework; storage bags disposed in each storage area; said upper and lower frameworks being separable to form the second mode of use of said structure as a cot when said upper and lower frameworks are horizontally disposed apart from one another on the ground with said outer side the disposed facing upwards; said second mode including a planar cot member attached to the upper facing outer sides of each of said upper and lower frameworks; first and second extension poles attaching said upper and lower frameworks together and supporting said cot member; said backpack structure then disposable in its third mode wherein said lower framework includes a tent pole receipt aperture defined therein; a tent pole structure extending from said tent pole receipt aperture over said cot member to the ground beyond the sides of said cot member; a tent member extending over said tent pole structure, said tent member further including a tent bottom extending under said cot member to provide containment of said cot member within said tent member; and wherein said storage bags of the structure in its first mode contain said first and second extension poles, said tent pole structure and said tent member.

2. A backpack structure comprising:

an upper framework;

a lower framework separably attached to said upper framework;

said upper framework including:

an upper right front frame member having a top and a bottom;

an upper left front frame member having a top and bottom;

an upper right rear frame member having a top and bottom and an upper left rear frame member having a top and bottom;

an upper right central support member interconnecting the bottom of said upper right front frame member to the bottom of said said upper right rear frame member;

an upper left central support member interconnecting the bottom of said upper left front frame member to bottom of said upper left rear frame member;

an upper right support member interconnecting the top of said upper right front frame member to the top of said upper right rear frame member;

an upper left support member interconnecting said upper left front frame member to said upper left rear frame member;

said upper right support member, upper left support member, upper right central support member and upper left central support member separating said upper right front frame member and said upper left front frame member an equal distance apart from said upper right rear frame member and said upper left rear frame member;

an upper front cross brace interconnecting the top of said upper right front frame member to the top of said upper left front frame member;

an upper rear cross brace interconnecting the top of said upper right rear frame member to the top of said upper left rear frame member;

a strap support cross brace interconnecting said upper right rear frame member to said upper left rear frame member below said upper rear cross brace;

a lower right front frame member having a top and bottom;

a lower left front frame member having a top and bottom;

a lower front cross piece interconnecting the bottoms of said lower right front frame member to said lower left front frame member;

a lower right rear frame member having a top and bottom;

a lower left rear frame member having a top and bottom;

a lower rear cross brace interconnecting the bottom of said lower right rear frame member to the bottom of said lower left rear frame member;

a lower right support member interconnecting the bottom of said lower right front frame member to the bottom of said lower right rear frame member;

a lower left support member interconnecting the bottom of said lower left front frame member to the bottom of said lower left rear frame member;

a lower right central support member interconnecting the top of said lower left frame member to the top of said lower right rear frame member;

a lower left central support member interconnecting the top of said lower left front frame member to the top of said lower left rear frame member;

said lower right central support member, lower left central support member, lower right support member and lower left support member separating said lower right front frame member and said lower left front frame member an equal distance from said lower right rear frame member and said lower left rear frame member;

a first bracket member attached near the bottom of said lower right rear frame member;

a second bracket member attached near the bottom of said lower left rear frame member;

a back support member extending between said first bracket member and said second bracket member;

a first and second shoulder strap extending from said strap support cross brace to the bottoms respectively of said lower right rear frame member and said lower left rear frame member;

a first releasable joint formed between the bottom of said upper right front frame member and the top of said lower right front frame member;

a second releasable joint formed between the bottom of said upper left front frame member and the top of said lower left front frame member;

a third releasable joint formed between the bottom of said upper right rear frame member and the top of said lower right rear frame member;

a fourth releasable joint formed between the bottom of said upper left rear frame member and the top of said lower left rear frame member;

a planar cot member having a top and bottom portion, said top portion being affixed to said upper right front frame member, said upper left front frame member and said upper front cross brace; the bottom of said cot member being affixed to said lower right front frame member and lower left front frame member; said cot at its bottom further including adjustably positionable attachment means for attachment to said lower front cross brace, said cot member having a middle portion that in a first mode when the structure is used as a backpack is loose from said frame members, said middle portion having a first and second channel defined on each side thereof in alignment with said frame members, said structure defining an upper framework between said upper frame members and a lower framework between said lower frame members, each framework defining a area for storage bags when used in said backpack first mode, said frameworks being separable at said first, second, third and fourth joints and disposable on the ground on said rear frame members with said upper and lower frameworks pulled apart from one another and interconnected by the middle portion of said cot member; and first and second extension poles adapted to e removably placed respectively within said first and second channels in the middle portion of said cot member with said first extension pole releasably interconnecting the bottom of said upper right front frame member and the top of said lower right front frame member, and said second extension pole releasably interconnecting the bottom of said upper left front frame member and top of said lower left front frame member, said first and second extension poles supporting said middle portion of said cot member in a horizontal position.

3. The backpack structure of claim 2 in its third mode further including:

tent pole interconnection means disposed on said lower front cross brace;

a tent pole having a first and second end, said first end connected to said interconnection means and said tent pole extending from said interconnection means on said lower front cross brace over said cot member;

first and second side tent poles interconnected with the second end of said tent pole extending to the ground on either side of said formed cot member from said backpack; and a tent disposed over said tent pole and around and under said formed cot member, said tent adapted to be carried upon said frame work creating a structure utilizable as a backpack, convertible into a cot and then, to a cot-enclosed tent.

* * * * *